US005275295A

United States Patent [19]

Eisenlohr et al.

[11] Patent Number: 5,275,295

[45] Date of Patent: Jan. 4, 1994

[54] SORTATION SYSTEM FOR RECOVERING TOBACCO FROM CIGARETTE PACKS

[75] Inventors: Gerald Eisenlohr, Kernersville; David A. Grider, Greensboro; James G. Williams, III, High Point, all of N.C.

[73] Assignee: Lorillard Tobacco Company, New York, N.Y.

[21] Appl. No.: 10,447

[22] Filed: Jan. 25, 1993

Related U.S. Application Data

[63] Continuation of Ser. No. 685,372, Apr. 15, 1991, abandoned.

[51] Int. Cl.[5] ..... B07C 5/00

[52] U.S. Cl. ..... 209/536; 209/539; 209/583; 209/654

[58] Field of Search ..... 209/535, 536, 539, 569, 209/583, 654, 651, 934, 914; 198/461, 392

[56] References Cited

U.S. PATENT DOCUMENTS

| | | | |
|---|---|---|---|
| 1,878,315 | 9/1932 | Phelps | 209/654 |
| 4,230,218 | 10/1980 | Kunzmann | 198/461 |
| 4,236,640 | 12/1980 | Knight | 209/577 X |
| 4,369,875 | 1/1983 | Schmitz | 198/461 X |
| 4,519,942 | 5/1985 | Focke | 198/461 X |
| 4,549,662 | 10/1985 | Schoenig et al. | 209/539 |
| 4,558,777 | 12/1985 | Francioni | 198/461 |
| 4,622,875 | 11/1986 | Emery et al. | 209/535 X |
| 4,707,251 | 11/1987 | Jenkins | 209/583 X |
| 4,836,378 | 6/1989 | Lephardt | 209/536 X |
| 4,972,494 | 11/1990 | White et al. | 209/535 X |
| 5,001,951 | 3/1991 | Eisenlohr et al. | 198/457 X |

*Primary Examiner*—D. Glenn Dayoan
*Attorney, Agent, or Firm*—White & Case

[57] ABSTRACT

A sortation system for separating products such as returned cigarette packs. A conveyor system moves the products in a predetermined orientation and minimum spacing past a bar code reader. A turnstile device contains a plurality of diverting bars which are selectively rotatable across the conveyor path in either direction to eject selected products either to the right or left as desired. A processor controls the turnstile device based upon bar code information to separate selected products and to allow the remaining products to remain on the conveyor.

16 Claims, 5 Drawing Sheets

SORTATION SYSTEM FOR RECOVERING TOBACCO FROM CIGARETTE PACKS

This application is a continuation of application Ser. No. 685,372, filed on Apr. 15, 1991, now abandoned.

FIELD OF THE INVENTION

The present invention relates systems for sorting products bearing an external bar code symbol, and particularly for sorting returned goods such as cigarette packs.

BACKGROUND OF THE INVENTION

In the tobacco industry, the reclamation of tobacco from unsold cigarette packs, known as returned goods tobacco reclamation, requires the separation of various types of returned goods. For example, in recovering tobacco it is desirable to separate unusable from reusable goods and, with regard to the reusable portion, to separate menthol from non-menthol tobaccos. It may also be desirable to further separate foreign made cigarettes from domestic, in view of the difference in taste characteristics. It may also be desired to separate returned packs by brand, in order to retain the individual taste characteristics of the recovered tobacco. This operation has heretofore required manual separation, resulting in unacceptable separation errors and high labor costs.

At the present time, most packaged goods are sold in containers or packs carrying a universal product code, or UPC bar code, which identifies the goods. These codes can be read by a scanner, and the electronic signal thus produced can be used for various purposes such as inventory tracking and sales transactions.

Proposals have also been made to utilize the UPC code for purposes of sorting products. An example of one proposal in the tobacco industry is set out in Emery et al. U.S. Pat. No. 4,622,875. There, returned cigarette packs are moved along a conveyor and scanned by a UPC bar code reader. Packages are slit open by a water knife, and thereafter pass a series of air nozzles. The air nozzles are selectively activated by solenoid valves to apply pressurized air against the sides of the packs to blow the packs off the conveyor line at the appropriate location.

The Emery et al. system utilizes a first pair of ejector nozzles, followed by a pack sensor, and a second ejector nozzle for ejecting packages selected for ejection which were not ejected by the first ejector nozzles. It would be desirable to have a pack sortation system which does not require a backup ejection system and which does not require multiple air ejectors and associated solenoid controls.

SUMMARY OF THE INVENTION

The present invention is a method and apparatus for sorting products, for example cigarette packs, by specified categories using the UPC bar codes which are imprinted on each pack. The present invention also permits batches of cigarette packs of different sizes to be processed randomly on the same sorting line.

More particularly, an apparatus according to the invention includes a means for supplying products sequentially onto a conveyor in a predetermined orientation and a predetermined minimum spacing. A pair of bar code readers are positioned adjacent the conveyor path to read the bar code on products passing by the reader and to generate electrical signals representative of the bar code information. The electronic signals are sent to a processor, which distinguishes products according to the bar code information. A pack diverter, which is connected to receive output signals from the processor, acts to eject selected products from the conveyor.

In one embodiment, the apparatus comprises a centrifugal bowl feeder which aligns a collection of randomly distributed cigarette packs. The packs are fed sequentially onto the first of three transport conveyors in a single column, oriented such that the pack is flat and the longitudinal axis of the cigarette pack is in the direction of conveyor movement. The first transport conveyor discharges cigarette packs onto a second transport conveyor which moves at a reduced transport velocity to cause bunching of the cigarette packs. A metering roller, located at the discharge end of the second transport conveyor, releases cigarette packs onto a third transport conveyor, which operates at a higher transport velocity than the second conveyor, such that a predetermined minimum pack spacing is obtained.

A pair of bar code scanner heads are located to either side of the third transport conveyor, and a counter-rotatable pack diverter is located down line of the bar code scanners. Two pack position detectors are positioned, respectively, before and after the bar code scanning area, and a third pack position detector is located before the pack diverter.

A standard cigarette pack contains an identifying UPC bar code on one of the sides of the pack. By placing the pack flat on the conveyor, and orienting the pack longitudinally, one of the bar code scanners will be in position to read the cigarette pack UPC bar code regardless of pack orientation.

As each incoming cigarette pack passes the first pack detector, which was located in proximity to the transport conveyor immediately prior to the bar code scanner detection area, the bar code scanners are simultaneously triggered to scan the sides of the pack. When the second pack detector, located immediately down line of the bar code detection area, detects the pack, the bar code data is transmitted to an information and control system.

The third pack detector is located after the scanning area and immediately prior to the pack diversion area. Working in conjunction with the information and control system, this pack detector provides a synchronization signal for the initiation of pack diversion. As the pack enters this area, the information and control system either actuates the pack diverter to divert the pack to the right or left of the transport conveyor, or allows the pack to continue on the conveyor, depending upon the product identification made from the bar code information.

A preferred embodiment of the counter-rotatable pack diverter includes a turnstile device attached to a computer driven servomechanism with a horizontal turnstile shaft mounted parallel to, and above, the third transport conveyor. The turnstile device includes a plurality, preferably four, diverting bars which are spaced outwardly from the turnstile shaft and which, upon rotation of the turnstile shaft, move across the transport path. Preferably, the bars are mounted on the ends of arms extending from the turnstile shaft, which are 90° apart.

In its rest position, the turnstile device is such that two diverting bars are positioned on either side of the transport conveyor. The arrival of a pack at the third pack detector causes a signal to be sent to the information and control system. In response to the corresponding bar code data, the information and control system causes the servomechanism to rotate the turnstile device 90° clockwise or counterclockwise, or causes the turnstile device to remain stationary. Rotation of the turnstile device causes a diverting bar to move across the transport path and eject the cigarette pack from the transport conveyor, either to the right of to the left depending upon the direction of turnstile rotation. Where the turnstile is not actuated, the pack continues on the conveyor. This sequence of events thus permits the separation of three distinct categories of cigarette packs. The information and control system provides also for collection and assimilation of information regarding the returned goods inventory.

In one method of operation, the sortation system according to the invention may be used to separate returned cigarette packs into categories of menthol domestic, non-methanol domestic, and other cigarette packs. Alternatively, the diverter can be used to separate two particular cigarette brands from the remaining cigarettes. Moreover, it is possible to place additional deflector mechanisms along the conveyor line, each additional deflector mechanism allowing the option of separation of two additional categories of returned cigarette packs.

For a better understanding of the invention, reference is made to the following detailed description of a preferred embodiment, taken in conjunction with the drawings accompanying the application.

DETAILED DESCRIPTION OF THE PREFERRED EMBODIMENTS

Figure 1:
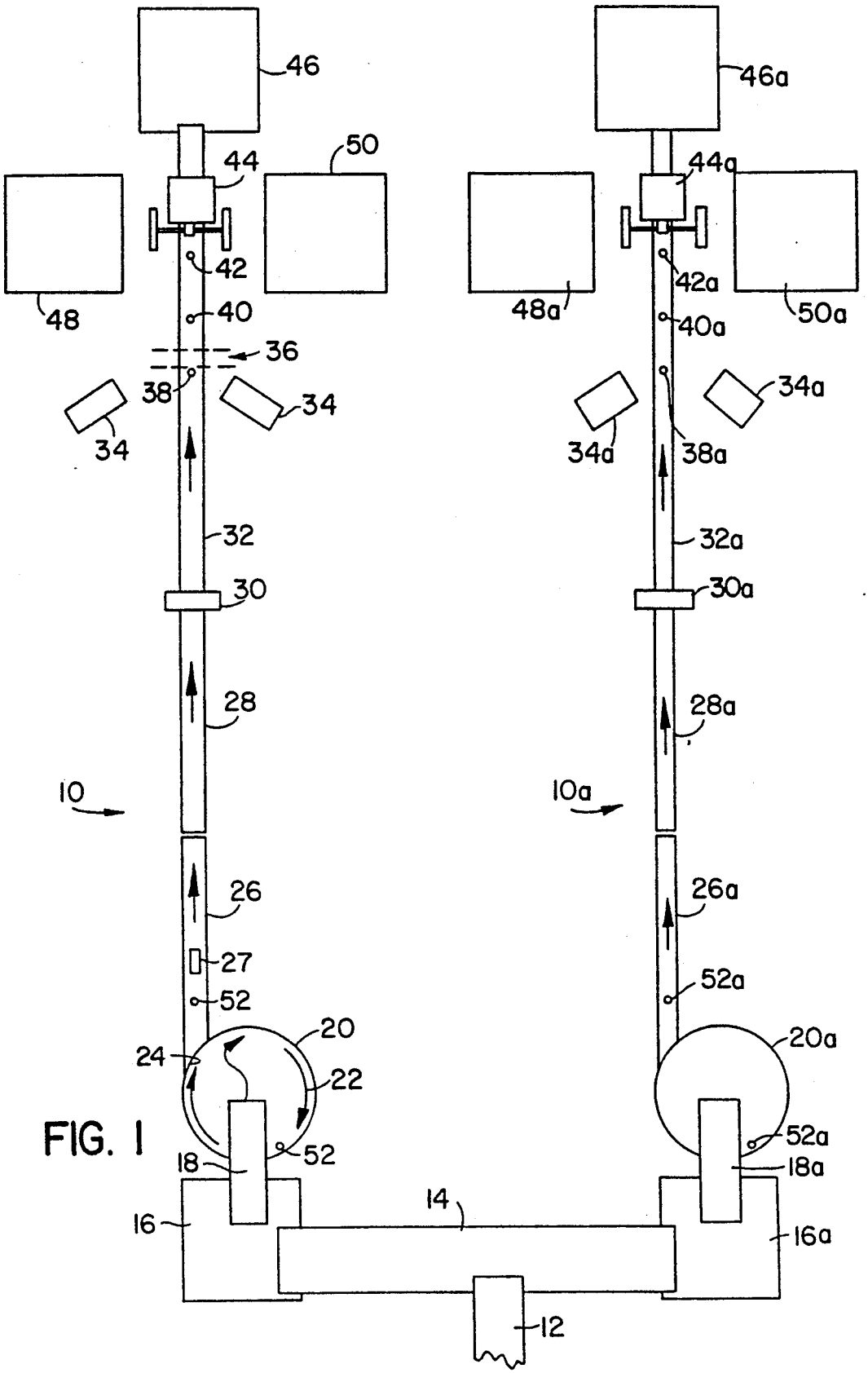
FIG. 1 is a top, schematic view of a sortation system according to the invention.

The sortation system illustrated in FIG. 1 includes a pair of parallel sortation lines 10, 10*a*. However, the system may include only a single line, or may include additional sortation lines, as desired.

As shown in FIG. 1, cigarette packs are directed into the automatic sortation system along an inclined conveyor 12 which directs the packs onto a reversing cross conveyor 14. From there, cigarette packs flow in either direction on conveyors 14 toward one of the sorting lines 10 or 10*a*. Referring to sorting line 10, packs from conveyor 14 are fed to a hopper 16 and up an inclined feeder conveyor 18 to a rotating bowl feeder 20. As shown by arrows 22, cigarette packs introduced in the bowl feeder 20 are directed through an outlet 24 and onto a first transport conveyor 26. The bowl feeder orients the packs so that, upon exiting the outlet 24, they lie flat on the transport conveyor 26, in the lengthwise direction, as shown by pack 27. Centrifugal bowl feeders for aligning and feeding articles end-to-end and flatwise are well known and described in Eisenlohr et al. U.S. Pat. No. 5,001,951.

At the end of the transport path of the first conveyor 26, a second transport conveyor 28 is positioned to receive the traveling cigarette packs. Transport conveyor 28 is set to operate at a slower transport speed than conveyor 26, such as to cause a bunching of cigarette packs. At the end of the path of transport conveyor 28, a metering roller 30 is positioned from which the packs move onto a third transport conveyor 32. Transport conveyor 32 is set to operate at a transport speed faster than transport conveyor 28, such that there will be a predetermined minimum spacing between cigarette packs on the third transport conveyor 32.

A pair of bar code scanners 34 are positioned on either side of the third transport conveyor 32 and set to scan the sides of the longitudinally oriented cigarette packs as they pass through a scanning area, indicated as 36. Any suitable bar code scanner, such as an Allen Bradley 2755-L4F may be used.

A first pack detector 38, which may be an inductive proximity switch, is positioned immediately up line of the bar code scanning area 36. A second pack detector 40 is positioned immediately down line of the bar code scanning area 36. Finally, a third pack detector 42 is positioned immediately up line of a pack diversion device in the form of a rotatable turnstile 44. The third transport conveyor 32 discharges into a mobile collection box 46, and a pair of mobile collection boxes 48, 50 are located to either side of the turnstile device 44. Preferably, also, cigarette pack jam sensors 52 are located at various points of the sortation line. The second line 10*a* is similar to sortation line 10, with corresponding components bearing the same numbers and designated "a".

Figure 2:
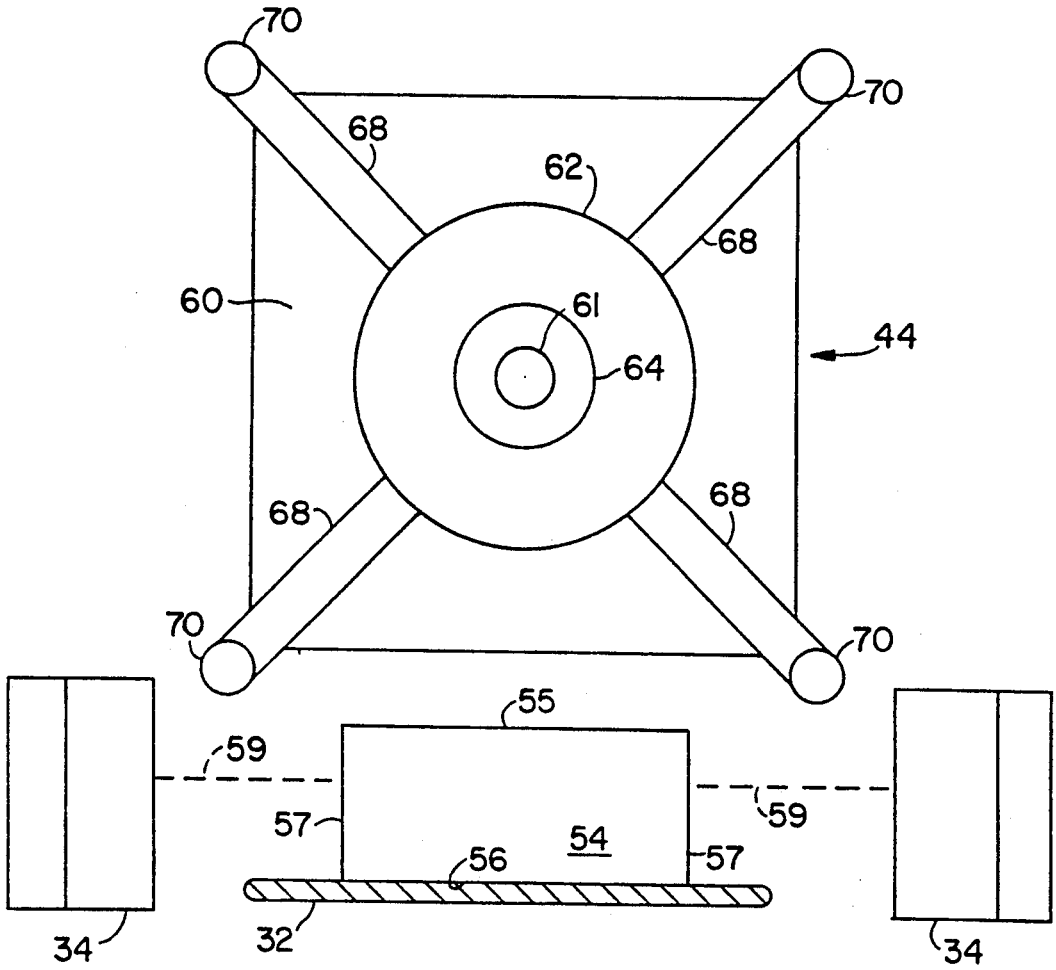
FIG. 2 is a sectional view, taken in the direction of lines 2—2 of FIG. 1, of the diversion area of the system.
Figure 3:
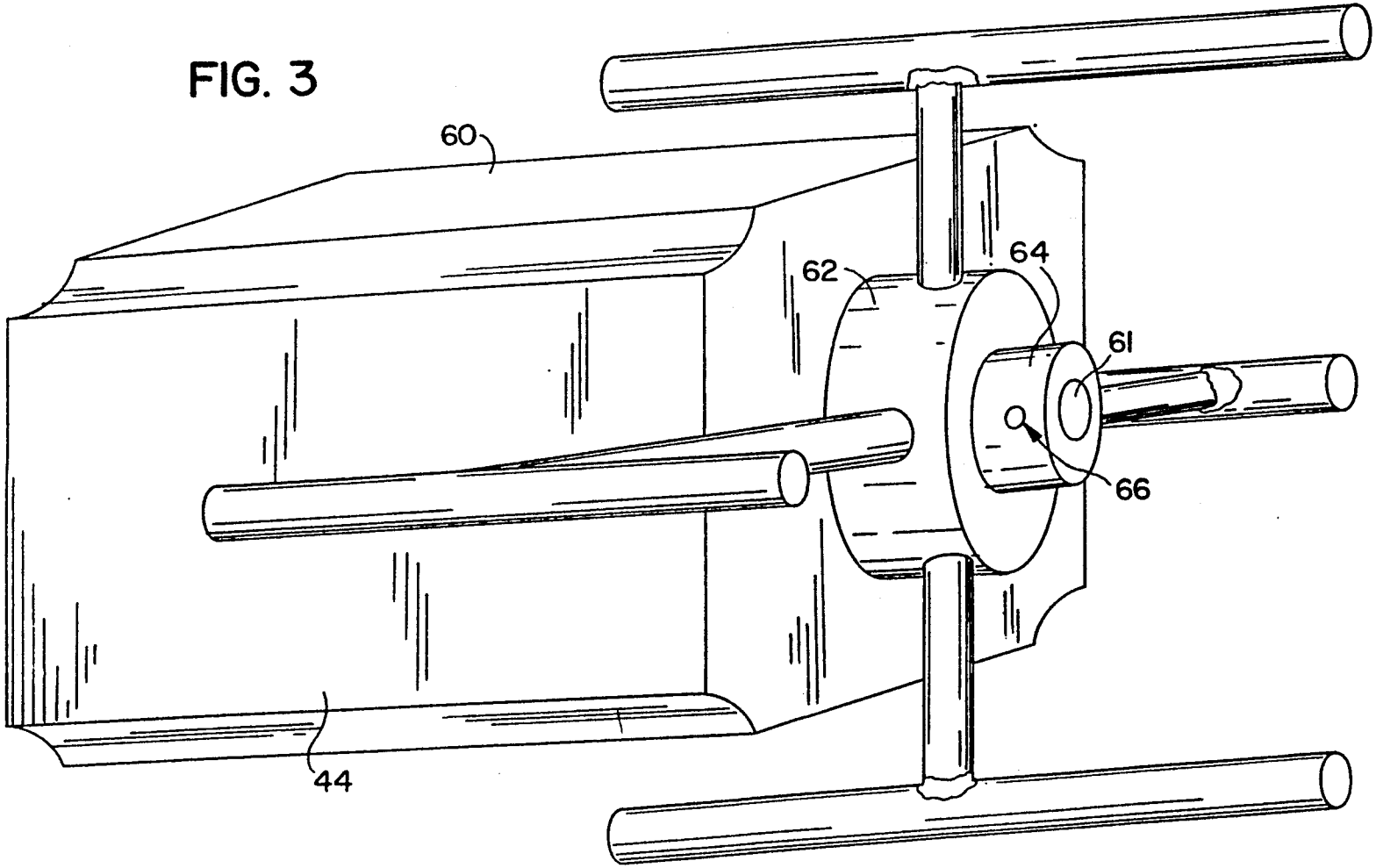
FIG. 3 is block diagram of a control panel for the system of FIG. 1.

Referring to FIG. 2, a cigarette pack 54 is shown having a front 55, a back 56, a pair of sides 57, and a bottom 58 (the top facing in the opposite direction). The pack 54 rests flat upon the third transport conveyor 32, i.e., either the front 55 or back 56 of the pack rests on the conveyor 32, and is longitudinally oriented such that the sides 57 of the pack face laterally outward and are within the path of the scanning rays 59 of the bar code scanners 34.

The turnstile device 44 is positioned over the third transport conveyor 32. The device 44 includes a servomotor 60 having an output motor shaft 61 which forms the turnstile shaft, and whose central rotation axis is directly above, and parallel to the direction of motion of the third transport conveyor 32. An example of a suitable servomotor 60 is Parker Compumotor Model 710, which is driven by a computerized servo drive (for example Parker Compumotor Model KHX) and which can be set to rotate 90° responsive to a control signal. A hub 62 is mounted on shaft 61 for rotation therewith. The hub 62 is held onto the shaft 61 by a holding sleeve 64, which is locked on the hub by a locking pin 66.

A plurality, preferably four, arms 68 extend from hub 62, perpendicular to the axis of the shaft 61, and a diverter bar 70 is secured, e.g., by welding, to the end of each arm 68. The diverter bars 70 are oriented parallel to the axis of shaft 61 and can rotate without hitting the housing of servomotor 60.

As shown in FIG. 2, the diverter bars 70 and arms 68 are located at 90° intervals, and at rest a pair of diverter bars 70 are located on either side of the transport path of the third transport conveyor 32. Thus, as shown in FIG. 2, cigarette packs on conveyor 32 may pass under the diverter device 44 and continue along conveyor 32 to the bin 46. At the same time, as a cigarette pack 54 passes under the turnstile device 44, rotation of the turnstile shaft 61 in either direction will cause one of the diverter bars 70 to eject the pack 54 from the conveyor belt 32. Moreover, in view of the multiple diverter bars, by controlling the direction of rotation of shaft 60 the pack can be ejected either to the right or to the left as desired.

Figure 4:
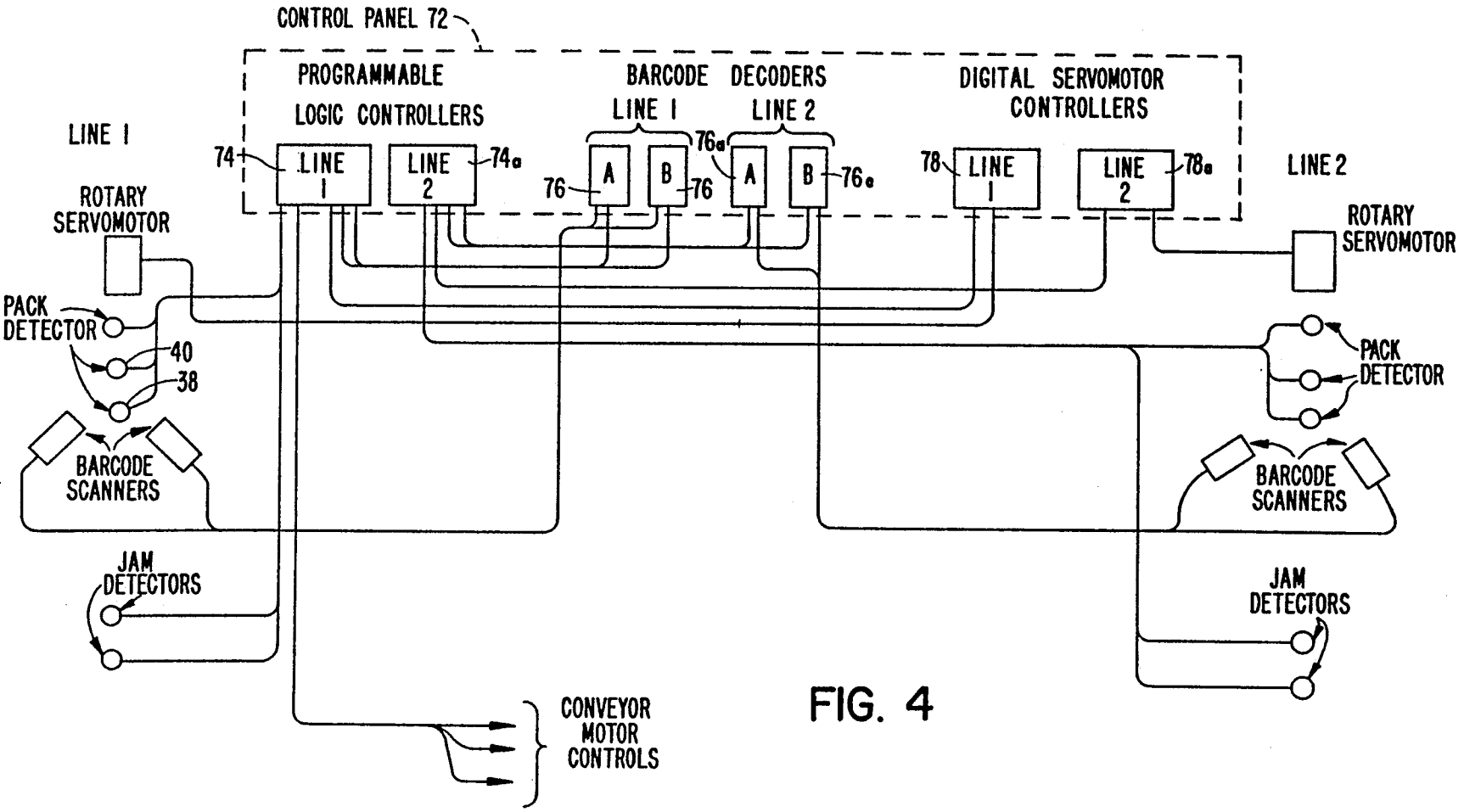
FIG. 4 is a perspective view of turnstile device and servomotor for use in the system of FIG. 1.

Referring to FIG. 4, the sortation lines 10, 10*a* are controlled from a control panel 72, which includes a programmable logic controller 74 for each of the two lines 10, 10*a*, a pair of bar code decoders 76, 76*a*, one for each line, and a pair of digital servomotor controllers 7B, 78*a*, one for each line. The programmable logic controller 74 for the first sortation line may be a model PLC 5/15 (1785-LT) manufactured by Allen-Bradley, which includes a pair of 1771-DA ASCII I/O modules, a 1771-P4 power supply, a 1771-OG TTL output module, a 1771-IAD AC input module, a 1771-IV DC input module, and a 1771-OAD AC output module. The controller includes inputs from the jam detectors 52, pack detectors 38, 40, 42, and bar code detectors 76, and includes outputs to the motor controls for conveyors 26, 28, 32, and an output for the digital servomotor controller 78, which in turn actuates the rotary servomotor 60. An example of a servomotor controller is Parker-Compumotor Model KHX, and of a bar code decoder is Allen-Bradley Model 2755-DMI. The program logic controller 74*a* for the second line includes corresponding inputs and outputs.

In operation, cigarette packs which are fed from the centrifugal bowl feeder 20 onto the first transport conveyor are transported to the second transport conveyor 28 at a rate such that a desired number of cigarette packs bunch up behind the metering roller 30. Metering roller 30 is located above the second transport conveyor 28, and ensures that packs passing under the roller 30 move at the speed of conveyor 28 until they have entirely passed through roller 30, whereafter such packs will be accelerated by transport conveyor 32. In this manner the packs passing through the metering roller will assume a predetermined minimum spacing on the conveyor 32 (there will be some variance in actual spacing, since "king size" packs will take longer to pass through roller 30 than regular size packs, thus leaving a slightly greater spacing).

As each pack passes the first pack detector 38, the programmable logic controller signals the bar code scanners 34 to scan both sides 57 of the packs as they pass through bar code scanning area 36. Because the packs are oriented flat and in end-to-end relation, one of the two sides of the pack, facing the bar code scanners 34, will contain the UPC bar code, which will be read by the respective scanner 34. As the pack leaves the first pack detector 38, the programmable logic controller 74 reads the bar code information from the bar code decoder 76, and compares such information with stored bar code information.

The sortation line 10 is set up to separate returned cigarette packs into three categories. In an exemplary system, the three categories selected may be menthol domestic, non-menthol domestic, and other (which would include non-recognized codes or read errors). When the pack reaches the second pack detector 40, the programmable logic controller issues a signal to the digital servomotor controllers 78 as follows: if the bar code indicates that the pack is of a first category (e.g., domestic menthol), programmable logic controller 74 issues a signal to the servomotor control to rotate the servomotor 44 clockwise 90°. This will cause the diverter bar 70 to eject the pack into the bin 48. If the bar code indicates that the cigarette is a second category (e.g. domestic menthol), the programmable logic controller issues a control signal to the digital servomotor controller 78 causing the motor to rotate counterclockwise by 90°. This causes the bar 70 on the opposite side to eject the pack to the right into the holding bin 50. If the bar code indicates that the pack is the third variety (e.g. anything else or non-recognizable), no control signal is sent to the servomotor, and the pack continues along the third transport conveyor 32 into the third bin 46.

Figure 5A:
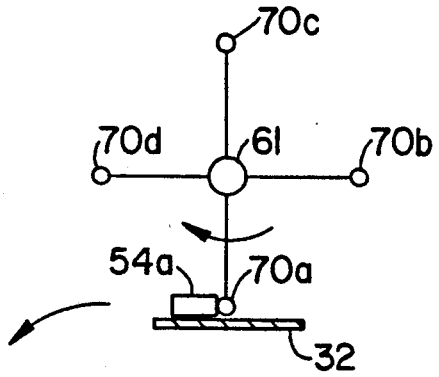
FIGS. 5*a*–5*c* are schematic drawings illustrating the operation of the turnstile device.
Figure 5B:
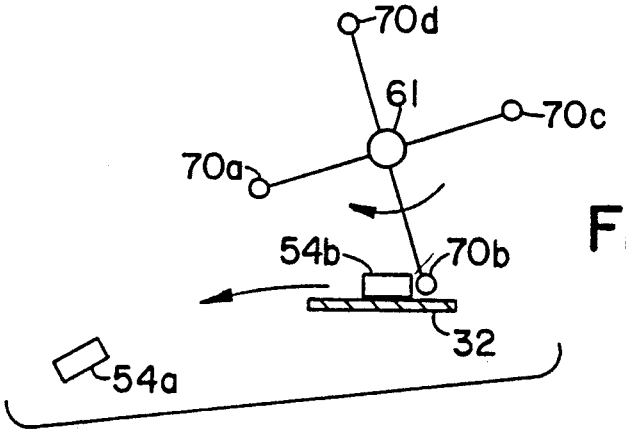
Figure 5C:
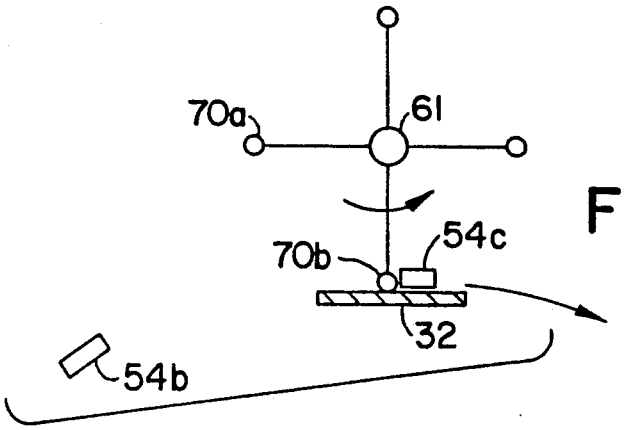

FIGS. 5*a*–5*c* illustrate one processing sequence for three consecutive packs moving on conveyor 32. In this example, the first two packs in the sequence, packs 54*a* and 54*b*, are of similar type, whereas pack 54*c* is of a different type and to be sorted separate from packs 54*a*–*b*. As the first pack 54*a* passes under the turnstile device 44, shaft 61 rotates 90° clockwise, and diverter bar 70*a* ejects the pack 54*a* to the left (e.g., into storage bin 48). As the second pack 54*b* reaches the turnstile 44, the shaft rotates clockwise another 90°, causing diverter bar 70*b* to eject pack 54*b* to the left. When the third pack 54*c*, which contains a different product type than packs 54*a*–*b*, reaches the turnstile, the processor causes shaft 61 to rotate 90° counterclockwise, and bar 70*b* ejects pack 54*c* to the right. Although not illustrated in FIGS. 5*a*–*c*, assuming that a subsequent product were to be of the third sortation category, upon reaching the turnstile device 44 the bars 70*a*, 70*b* would remain stationary and the product would remain on the conveyor 32. Moreover, assuming that product 54*c* and subsequent products were to be of the same type as products 54*a*–*b*, then the shaft 61 would continue to rotate clockwise with arms 70*c* and 70*d* ejecting subsequent products to the left. As is evident, the device does not need to be reset between packs, irrespective of the direction of desired rotation, and can thus react quickly.

As illustrated in FIG. 5*b*, a product 54*b* which is centered on the conveyor belt 32 will be impacted by the diverter bar 70*b* before the arm 68*b* has reached the bottom of its arc. However, because the bar 70*b* has a cross-sectional width w—w, in the direction of rotation, which is greater than the width of the arm 68*b*, the bar 70*b*, rather than the arm, contacts the product. Moreover, because the bar 70*b* contacts the product 54*b* along the sidewall 57 of the product, and because the bars 70*a*–70*d* are cylindrical, the mutual contacting surfaces of the bar and product are perpendicular to the plane of the conveyor belt.

As is evident from the drawings, with the ejection turnstile device of the present invention, having multiple ejection bars 70, the device 44 need rotate only 90° in order to eject the pack from the conveyor 32. Moreover, the device can readily eject a series of packs into the same bin 48, 50, or alternating bins 48, 50, or any combination thereof, without the need to reset between ejections. Moreover, in view of the fact that the packs are given a predetermined minimum spacing on the third conveyor 32, the ejection bars 70 can be made considerably longer than the length of the pack, to ensure that packs will be reliably ejected into the proper bin. At the same time, due to the minimum spacing and the use of pack position sensors to control scanning and the turnstile, the sortation system can process varying size cigarette packs sequentially.

Once the returned goods are sorted, the packs are normally subjected to processes to open the packs and separate the tobacco from the paper and filter. An example of such a process is described in co-owned Eisenlohr et al. U.S. Pat. No. 5,001,951.

The foregoing represents a preferred embodiment of the invention. Variations and modifications will be apparent to persons skilled in the art, without departing from the inventive principles disclosed herein. For example, the invention has been described with reference to sorting returned cigarette packs according to bar code information. The sortation system of the present invention may readily be used in sorting other types of products or containers using the same principles. Moreover, while the sortation line is shown with a single ejection device 44, which can sort three different types of products, in theory any number of sortations can be made by adding additional devices 44 down line. All such modifications and variations are intended to be within the scope of the invention, as defined in the following claims.

We claim:

1. Apparatus for sorting products bearing an external bar code symbol, comprising:

means for supplying the product sequentially onto a conveyor means in a predetermined orientation and a predetermined minimum spacing between products;

conveyor means for moving the products along a transport path;

a bar code reader means adjacent said path and positioned to read the bar code on products passing thereby, the bar code reader having means to generate electrical signals representative of the bar code;

detector means located downline of said bar code reader for sensing position of products after passing said bar code reader and for generating detection signals responsive thereto;

processor means for receiving said electrical signals from said bar code reader and said detection signals from said detector means, and for generating output control signals responsive to certain bar codes and said detection signals; and ejection means, located downline of said detector means, connected to receive the output control signals of said processor means, wherein he ejection means comprises a rotary turnstile having a turnstile shaft, a plurality of arms extending radially from said shaft, and an ejection member on each arm and spaced for contacting products on said conveyor means, wherein said ejection means further includes drive means acting on said turnstile for rotating said shaft through a predetermined angle and direction, responsive to output control signals from said processor means, for ejecting individual products laterally to either side of said conveyor means, wherein said ejection members and arms have a cross-sectional width in the direction of rotation, wherein the cross-sectional width of said ejection members is greater than said arms such that, upon rotation, an ejection member, rather than an arm, contacts the product, and wherein the drive means includes a rest position in which a pair of ejection members are located to either side of the transport path.

2. Apparatus according to claim 1, wherein said shaft is located above, and parallel to, said transport path, and wherein the ejection members comprise a cylindrical ejection bar, at the end of each arm, oriented parallel to the transport path and movable across the transport path upon rotation of the shaft.

3. Apparatus according to claim 2, wherein said processor means includes programmable means for generating a first output control signal responsive to at least one first ar code reading, and means for generating a second output control signal responsive to at least one second bar code reading, and wherein said drive means includes means for rotating said shaft in a first direction and second direction, respectively, responsive to said first and second output control signals.

4. Apparatus according to claim 1, wherein said detector means is located directly downline of said bar code reader, and said ejection means is located directly downline of said detector means.

5. Apparatus for sorting returned packs of cigarettes of various brands bearing an external bar code symbol, comprising:

means for supplying the packs sequentially onto a conveyor means in a flat, end-to-end orientation and a predetermined minimum spacing between packs;

conveyor means for moving the packs along a transport path;

a bar code reader means adjacent said path and positioned to read the bar code on packs passing thereby, the bar code reader having means to generate electrical signals representative of the bar code;

processor means for receiving said electrical signals from said bar code reader and for generating output control signals responsive to certain bar codes; and ejection means, located downline of said detector means, connected to receive the output control signals of said processor means, wherein the ejection means comprises a rotary turnstile having a turnstile shaft, a plurality of arms extending radially from said shaft, and an ejection member on each arm and spaced for contacting a pack on said conveyor means, wherein said ejection means further includes drive means acting on said turnstile for rotating said shaft through a predetermined angle and direction, responsive to output control signals from said processor means, for ejecting individual packs laterally to either side of said conveyor means, wherein said ejection members and arms have a cross-sectional width in the direction of rotation, wherein the cross-sectional width of said ejection members is greater than said arms such that, upon rotation, an ejection member, rather than an arm, contacts the pack, and wherein the drive means includes a rest position in which a pair of ejection members are located to either side of the transport path.

6. Apparatus according to claim 5, wherein said shaft is located above, and parallel to, said transport path, and wherein the ejection members comprise a cylindrical ejection bar, at the end of each arm, oriented parallel to the transport path and movable across the transport path upon rotation of the shaft.

7. Apparatus according to claim 6, wherein said processor means includes programmable means for generating a first output control signal responsive to at least one first bar code reading, and means for generating a second output control signal responsive to at least one second bar code reading, and wherein said drive means includes means for rotating said shaft in a first direction and second direction, respectively, responsive to said first and second output control signals.

8. Apparatus according to claim 5, further comprising a detector means for sensing position of packs after passing said bar code reader and for supplying detection signals to said processor means responsive thereto; and wherein said processor means generates said output control signals responsive to certain electrical signals and said detection signals.

9. Apparatus according to claim 8, wherein said ejection means is located directly downline of said detector means, and wherein said detector means is located directly downline of said bar code reader.

10. Apparatus according to clam 7, further comprising a detector means located directly downline of said bar code reader for sensing position of products after passing said bar code reader; and wherein said ejection means is located directly downline of said detector means.

11. Method for sorting products bearing an external bar code symbol, comprising the steps of:

supplying the product sequentially onto a conveyor means in a predetermined orientation and a predetermined minimum spacing between products;

moving the products on said conveyor means along a transport path;

providing a bar code reader means adjacent said path and positioned to read the bar code on products passing thereby;

reading bar codes on passing products and generating electrical signals representative of the bar code;

providing said electrical signals from said bar code reader to a processor means and generating output control signals responsive to certain ar codes;

providing a product detection means downline of said bar code reader;

providing a rotary turnstile having a turnstile shaft, a plurality of arms extending radially from said shaft, and an ejection member on each arm, wherein the ejection members are movable, with rotation of said shaft, across the transport path in either direction, dependent upon the direction of rotation, for ejecting individual products laterally to either side of said conveyor means, wherein said ejection members and arms have a cross-sectional width in the direction of rotation, wherein the cross-sectional width of said ejection members is greater than said arms such that, upon rotation, an ejection member, rather than an arm, contacts the product;

positioning said turnstile downline of said detector means;

providing said output control signals of said processor means to said ejection means;

detecting the position of the product, using said detector means, just prior to reaching said ejection means; and rotating said shaft in a predetermined direction responsive to selected output control signals, coincident with the arrival of a selected product to be ejected, such that an ejection member contacts the product to eject it from the conveyor means.

12. Method according to claim 11, comprising the step of rotating said shaft through a predetermined angle and direction responsive to output control signals from said processor means and, between control signals, maintaining the turnstile at a rest position in which a pair of ejection members are located to either side of the transport path.

13. Method according to claim 12, comprising the step of locating the shaft above, and parallel to, said transport path, wherein said arms extend in a plane perpendicular to said shaft, and providing the each of the ejection members with an ejection bar, at the end of each arm, oriented parallel to the transport path and movable across the transport path upon rotation of the shaft.

14. Method according to claim 13, comprising the steps of generating a first output control signal responsive to at least one first bar code reading, generating a second output control signal responsive to at least one second bar code reading, and rotating said shaft in a first direction and second direction, respectively, responsive to said first and second output control signals.

15. A method according to claim 11, wherein the ejection members comprise cylindrical ejection bars.

16. A method according to claim 11, wherein the detector means is located directly downline of the bar code reader, and the ejection means is located directly downline of the detector means.

* * * * *